United States Patent [19]

Fleck et al.

[11] 4,094,672

[45] June 13, 1978

[54] METHOD AND CONTAINER FOR HOT ISOSTATIC COMPACTING

[75] Inventors: James N. Fleck, Pittsburgh, Pa.; Richard C. Palmer, East Liverpool, Ohio; Charles L. Ruffner, Pittsburgh, Pa.

[73] Assignee: Crucible Inc., Pittsburgh, Pa.

[21] Appl. No.: 642,976

[22] Filed: Dec. 22, 1975

[51] Int. Cl.[2] ..... B22F 3/00

[52] U.S. Cl. ..... 75/226; 264/111; 264/DIG. 50

[58] Field of Search ..... 264/111, DIG. 50; 75/226

[56] References Cited

U.S. PATENT DOCUMENTS

| | | | |
|---|---|---|---|
| 3,577,635 | 5/1971 | Bergman et al. | 264/111 |
| 3,599,281 | 8/1971 | Boyer | 75/226 |
| 3,939,241 | 2/1976 | Powell et al. | 264/111 |
| 3,956,452 | 5/1976 | Saito | 264/DIG. 50 |

*Primary Examiner*—Brooks H. Hunt

[57] ABSTRACT

A method and container for hot isostatic compacting of powder metallurgy charges in a sealed container wherein the container may be both easily removed from the charge after compacting and preserved for subsequent reuse; this is achieved by providing a separating medium between the container interior and the powdered metal charge to prevent bonding during hot isostatic compacting, and removing the compacted charge from the container by introducing fluid under pressure to the container interior to expand the same away from the compacted charge and then providing an opening in the container, preferably at the end thereof, through which the compact is withdrawn.

2 Claims, 3 Drawing Figures

METHOD AND CONTAINER FOR HOT ISOSTATIC COMPACTING

In the art of powder metallurgy it is known to place a powdered metal charge in finely divided particle form in a sealed metal container for hot isostatic compacting, typically by the use of a gas pressure vessel. The powdered metal charge may be of prealloyed powder such as that formed by various of the conventional powder-manufacturing techniques or may be a mixture of elemental particles constituting the desired final compacted article composition. The metal containers used for the purpose are generally made of mild steel having a wall thickness on the order of at least 1/16 in. In applications wherein hot isostatic compacting is achieved by the use of a gas, such as nitrogen or helium, in contact with the container exterior it is necessary that the container be impervious. In a typical application wherein high-speed steel prealloyed powder is compacted to form billets the container is of mild steel and of generally cylindrical construction. Upon the application of fluid pressure the container collapses to permit compacting to the required density. Prior to compacting, the container is in the conventional manner outgassed to remove impurities, such as oxides, and after outgassing the container is sealed against the atmosphere. It is then heated to a temperature suitable for hot isostatic compacting to achieve the selected density. In the case of high-speed steel this temperature may be on the order of 2000° F. The container and charge at this temperature are then placed in a gas pressure vessel, commonly termed an autoclave, and by the application of a gas, such as nitrogen or helium, at a pressure on the order of 10,000 to 15,000 p.s.i. hot isostatic compacting is achieved. During compacting in accordance with this well-known practice, the container becomes bonded to the compact. Typically, therefore after compacting and cooling to ambient temperature the container is removed from the compact by machining, pickling or a combination thereof. This is, of course, a time-consuming and expensive operation and in addition completely destroys the container so that it cannot be reclaimed for subsequent use, all of which adds to the overall expense of the powder metallurgy operation. It is likewise known to provide the interior of the container with a separating medium coating to prevent bonding between the interior of the container and the powder metallurgy charge during compacting. After compacting the container is slit longitudinally and the residual stresses produced in the container during compacting cause it to spring away from the compact, thus permitting easy removal of the compact from the container. In this application, however, the container cannot be reused without significant repair to the cylindrical body portion of the container.

It is accordindly the primary object of the present invention to provide a method and container for hot isostatically compacting powder metallurgy charges in a sealed metal container whereby the compact may be easily removed from the container without requiring removal operations such as machining, pickling or combinations thereof, and without requiring slitting or otherwise damage to the container, whereby the container is suitable for reuse.

This and other objects of the invention, as well as a more complete understanding thereof, may be obtained from the following description, specific examples and drawings, in which.

Broadly, in the practice of the invention in the conventional manner a powder metallurgy charge is placed in a sealed metal container and more specifically a cylindrical metal container having a cylindrical body portion closed at each end by a generally disc-shaped end plate. The container with the powder metallurgy charge therein is heated to an elevated temperature suitable for hot isostatic compacting. The container and charge while at elevated temperature are then hot isostatically compacted by the application of fluid pressure to the exterior of the container to collapse the container and compact the charge therein to the desired density; the density achieved during compacting may be full density or to an intermediate density. The improvement of the invention comprises placing between the container interior and the charge, prior to heating and compacting, a means for preventing bonding therebetween. This may constitute a separating medium layer, which may be applied to the interior of the container. The separating medium, which for example may be flame sprayed aluminum oxide, may be a coating of an oxide such as alumina or the like or an oxide may be formed, in situ, on the container interior. During compacting, bonding is prevented between the container and the charge. The separating medium need not be placed on the end plates of the container as either one or both of these will be removed as by a sewing operation after compacting. After compacting fluid is introduced to the interior of the sealed container at a pressure sufficient to cause the container to expand away from the charge. This action is permitted by the separating medium layer preventing bonding between the container interior and powder metallurgy charge during compacting. Thereafter either one or both of the end plates are removed and the compact is withdrawn from the container through the end opening resulting from end-plate removal. Since slitting of the container is avoided during this removal operation, the container can be reused merely by providing the same, as by welding thereto, new end plates.

A steel container is customarily used particularly when the particle charge is prealloyed powder of an iron-base alloy. With regard to the separating medium coating, oxides such as alumina, which might be applied by flame spraying, or other ceramics or natural oxides could be used. All that is required of the particular coating is that under the temperature and pressure conditions incident to hot isostatic compacting that bonding between the container interior and the compacted charge be avoided to the extent that upon introducing to the interior of the container fluid under pressure such will cause the container to move away from the compact and thus render the compact easily removable from the container upon removal of one or both of the end plates.

Figure 2:
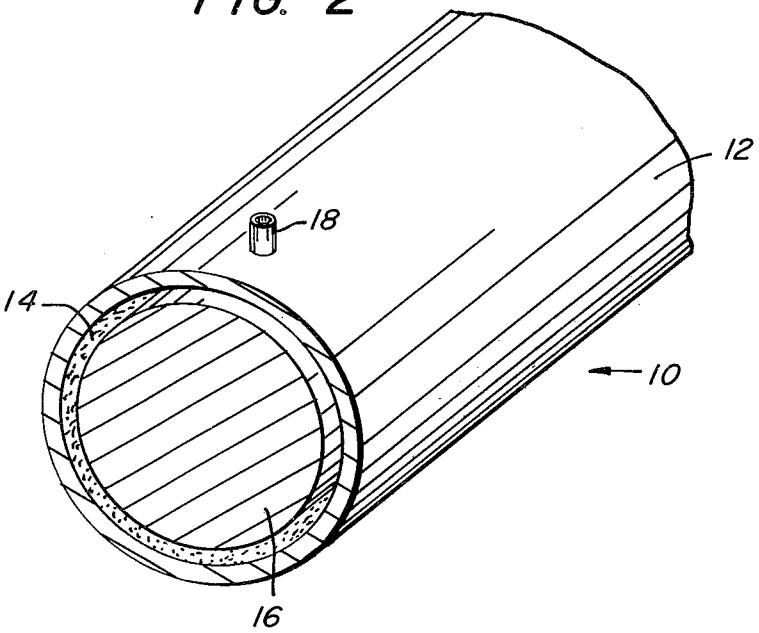
FIG. 2 is a schematic view in partial section of the powder-filled container of FIG. 1 after compacting and preparing the compact and container for removal in accordance with the invention.
Figure 1:
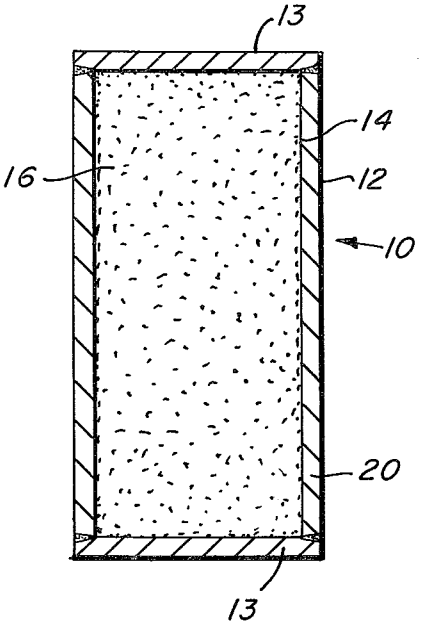
FIG. 1 is a schematic view in vertical cross section of one example of a powder-filled metal container suitable for use in the practice of the invention.

As a specific example of the practice of the invention, reference should be made to the drawings and for the present to FIGS. 1 and 2 thereof. FIGS. 1 and 2 show an assembly, designated generally as 10, suitable for use and typical of an assembly that would be used in the production of high-speed steel billets in accordance with the invention. The assembly 10 comprises a mild steel cylindrical container 12 having a 7 in. inside diameter and a length of 96 in. and having welded thereto disc-shaped end plates 13 and having an interior, separating medium layer 14, which in this instance was flame sprayed aluminum oxide. The container is filled with a powdered metal charge 16, which may be conventional prealloyed high-speed steel of the conventional M-2 composition with the particles being approximately minus 30 mesh U.S. Standard. As shown in FIG. 1, the container 12, after outgassing in the conventional manner, is readied for heating to suitable hot isostatic compacting temperature. After compaction, the container 12 is penetrated to admit a fluid by a piston-type pump connected to the assembly 10. This can be facilitated by attaching a threaded fitting 18 to the outside of the container 12. Upon the application of water at a pressure of approximately 3500 p.s.i., the container expanded away from the compact to an extent of about 3/16 in., at which time the introduction of the water under pressure was halted. Both end plates 13 were sawed from the container and the remaining surrounding cylindrical body portion was lifted off of the compact.

The above example was repeated, except that a mullite separating medium coating was used and applied as a slurry.

The example in the foregoing paragraph was repeated except that one of the end plates was also coated with mullite and the other end plate only was removed to permit withdrawal of the compact.

In all of the above examples the container was readily reusable.

Figure 3:
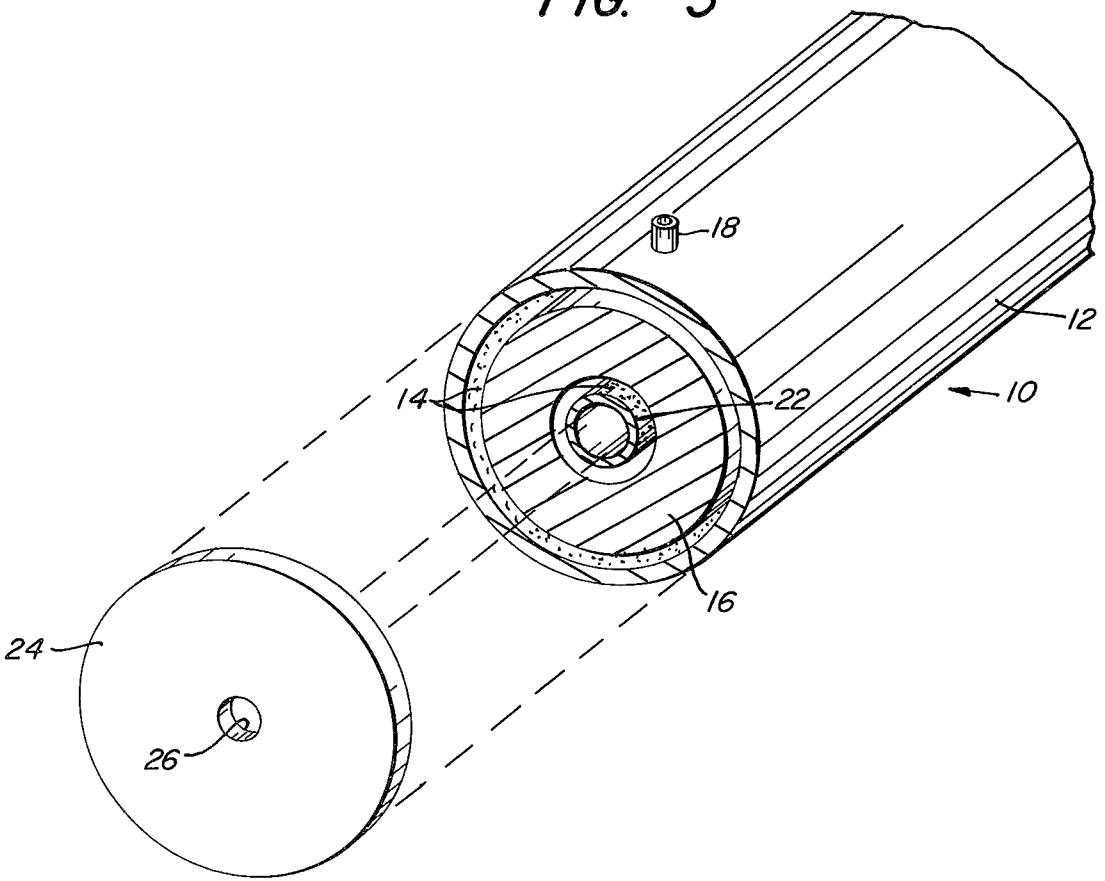
FIG. 3 is a schematic view in partial section of an alternate embodiment of the invention shown in FIGS. 1 and 2.

With reference to FIG. 3 of the drawings, there is shown an alternate embodiment of the invention wherein the same is used to produce a compact having a longitudinal passage from end to end, with the compacted article therefor constituting either a tube or a hollow-bar shape. As may be seen from FIG. 3, the container 12 is identical to that described hereinabove with reference to FIGS. 1 and 2. The difference in the practices involves the use of an inner axially positioned metal sleeve or tube 22 and end plates 24 in the form of an annular ring instead of a flat disc. Each end plate 24 has an opening 26, which when the end plate is welded in place communicates with the interior of sleeve 22. The powder charge for compacting and the resulting compact, which is designated as 16 in FIG. 3, are formed between the tube 22 and container 12. The exterior of the sleeve 22 and the interior of the container 12 are coated with a separating medium coating designated in both instances as 14. After compacting both the sleeve 22 and the container 12 are expanded away from the compact by the introduction of fluid under pressure as described hereinabove in accordance with the embodiment of the invention shown in FIGS. 1 and 2. Upon removal of the end plates 13, the compact is removed as described above with reference to FIGS. 1 and 2.

We claim:

1. A method for isostatically compacting powder metallurgy charges by the application of fluid pressure by:

(a) providing a cylindrical, metal container having a cylindrical body portion closed at each end by a generally disc-shaped end plate, (b) applying to the interior of said cylindrical body portion a separating medium layer for preventing bonding between said coated portion of said container and a powder metallurgy compact produced therein during subsequent application of said fluid pressure, (c) providing said container with a powder metallurgy charge, (d) sealing said container, (e) outgassing said container, (f) heating said container and charge to an elevated temperature, (g) applying fluid pressure to the exterior of said heated container to isostatically compact with charge therein to produce a powder metallurgy compact, and (h) releasing said pressure and cooling said container and compact, the improvement comprising:

(i) removing at least one end plate from said container, including all end plates not coated with said separating-medium layer, (j) introducing to the interior of said container a fluid under pressure sufficient to cause said container to move away from said compact, and (k) removing said compact from said container by withdrawing said compact through an end from which any said end plate has been removed, whereby the cylindrical body portion of said container is preserved for reuse.

2. A method for isostatically compacting powder metallurgy charges by the application of fluid pressure to produce a tubular compact by:

(a) providing a cylindrical, metal container having a cylindrical body portion closed at each end by a generally disc-shaped end plate, (b) applying to the interior of said cylindrical body portion a separating medium layer for preventing bonding between said coated portion of said container and a powder metallurgy compact produced therein during subsequent application of said fluid pressure, (c) providing said container with a powder metallurgy charge, (d) sealing said container, (e) outgassing said container, (f) heating said container and charge to an elevated temperature, (g) applying fluid pressure to the exterior of said heated container to isostatically compact said charge therein to produce a powder metallurgy compact, and (h) releasing said pressure and cooling said container and compact, the improvement comprising:

(i) axially positioning within said container a metal sleeve substantially coextensive with said container and having an outside diameter less than the inside diameter of said container to define an annular passage between said sleeve and said container, (j) said powder metallurgy charge being provided within said annular passage, (k) applying to the exterior of said sleeve a separating medium layer for preventing bonding between said sleeve and a powder metallurgy compact produced within said container during subsequent application of said fluid pressure, (l) providing an opening in said end plates communicating with the interior of said sleeve, (m) removing at least one end plate from said container, including all end plates not coated with said separating-medium layer, (n) introducing to the interior of said container a fluid under pressure sufficient to cause said container and said sleeve to move away from said compact, and (o) removing said compact from said container by withdrawing said compact through an end from which said end plate has been removed, whereby the cylindrical body portion of said container and said sleeve are preserved for further use.

* * * * *

UNITED STATES PATENT OFFICE

CERTIFICATE OF CORRECTION

Patent No. 4,094,672 Dated June 13, 1978

Inventor(s) James N. Fleck, Richard C. Palmer and Charles L. Ruffner

It is certified that error appears in the above-identified patent and that said Letters Patent are hereby corrected as shown below:

Column 4, line 14, change "with" to --said--.

Signed and Sealed this

*Thirty-first* Day of *October 1978*

[SEAL]

*Attest:*

RUTH C. MASON
*Attesting Officer*

DONALD W. BANNER
*Commissioner of Patents and Trademarks*